United States Patent [19]

Gagnebin

[11] 4,182,114

[45] Jan. 8, 1980

[54] TIME-PIECE WITH ELECTRIC MOTOR DRIVEN DISPLAY AND PLANETARY MOTION WORK

[75] Inventor: Pierre-Luc Gagnebin, Bienne, Switzerland

[73] Assignee: Societe Suisse pour l'Industrie Horlogere Management Services S.A., Switzerland

[21] Appl. No.: 814,566

[22] Filed: Jul. 11, 1977

[30] Foreign Application Priority Data

Jul. 12, 1976 [GB] United Kingdom ..... 28844/76

[51] Int. Cl.[2] ..... G04B 33/00

[52] U.S. Cl. ..... 58/59; 58/7; 58/139; 58/125 R

[58] Field of Search ..... 58/7, 23 R, 23 D, 26 A, 58/26 R, 52, 59, 125 R, 138, 139, 140 R

[56] References Cited

U.S. PATENT DOCUMENTS

| | | | |
|---|---|---|---|
| 3,190,066 | 6/1965 | Gardes et al. | 58/26 A |
| 3,747,329 | 7/1973 | Golay | 58/59 |
| 3,931,703 | 1/1976 | Scherrer et al. | 58/23 R |

*Primary Examiner*—Gene Z. Rubinson
*Assistant Examiner*—Leonard W. Pojunas, Jr.
*Attorney, Agent, or Firm*—Griffin, Branigan and Butler

[57] ABSTRACT

An electrically energized timepiece movement is provided with motion work in the form of a planetary train entirely supported on the frame of a driving motor. Coaxial planet pinions are excentrically located on a minute wheel, one planet pinion engaging a fixed central gear and the other engaging the hour wheel.

8 Claims, 1 Drawing Figure

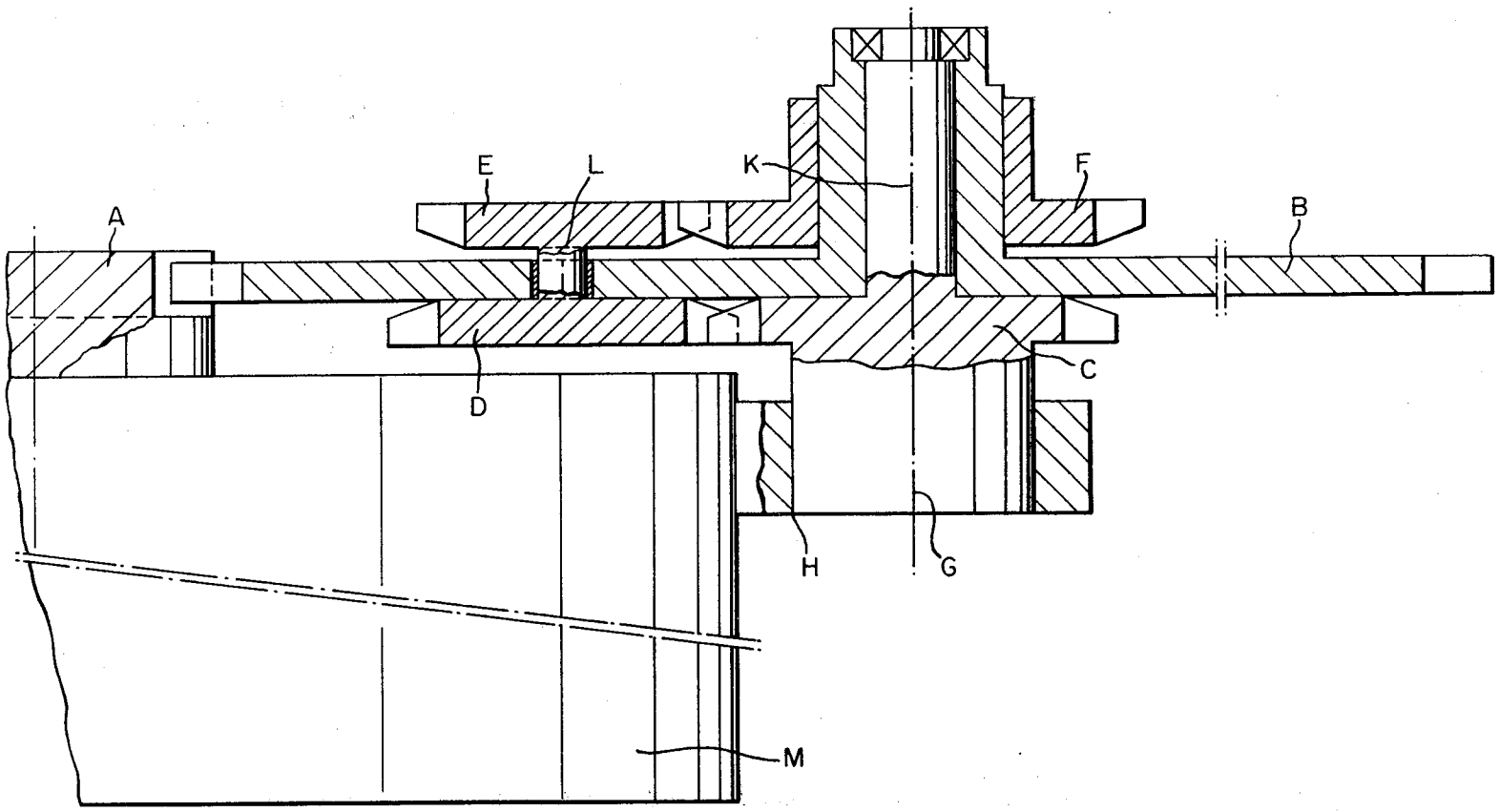
B
F
C
G
K
H
M
L
E
D
A

TIME-PIECE WITH ELECTRIC MOTOR DRIVEN DISPLAY AND PLANETARY MOTION WORK

BACKGROUND OF THE INVENTION

Timepieces of this general category have in recent years becomme well known and as in any new development provide many occasions to bring in improvements based on advanced technology. Thus, for example, the tendency in recent times has been to incorporate more and more details enabling complex systems of electronic controls whereby corrections which in respect of purely mechanical watches were effected by complex systems of gears and levers may now be effected in a relatively simple manner through the use of electronic circuits.

Notwithstanding the numerous features now to be found in present day electronic watches there still remains much to be done. Thus, such watches continue to exhibit a certain bulkiness and in general lack, to some extent at least, the elegance which may be associated with the finer types of purely mechanical watches. Although many improvements continue to be made, nevertheless to some extent at least, it is obvious that some basic rethinking is necessary if one is to take full advantage of the electronic possibilities and at the same time conserve the most important features of a watch while at the same time reducing the bulk to a point where such may be incorporated in fine jewellery.

The present invention through an improved type of motionwork contributes towards reduction of volume of a watch and as will subsequently be seen provides a step of considerable importance in achieving a really small electronic wrist watch movement which at the same time will conserve certain of the featuees which have been found practically indispensable for modern timepieces. To this end the movement in question is provided with a motion-work taking advantage of the space saving quality of planetary gearing. The various electronic particulars of such a watch which in fact enable to provide maximum control functions and correction functions in minimum volume through use of electronics do not form part of the present invention and will be referred to only in passing. It will be noted that among other particulars which have become superfluous by virtue of the present invention there is no need to provide a base or pillar-plate for the support of the numerous mechanical correcting arrangements often associated with prior art type of watch movements.

SUMMARY OF THE INVENTION

The invention accordingly comprises a timepiece movement including an electric motor arranged to transmit motion to a minute hand and an hour hand wherein the motion-work comprises a planetary train having a minute wheel directly driven from the motor and bearing a pair of coaxial planet pinions arranged respectively to engage a fixed central gear and the hour wheel.

BRIEF DESCRIPTION OF THE DRAWING

For a better understanding of the invention reference will now be made to the accompanying drawing which shows in basic outline form the mechanical motion-work arrangement as taught by this invention.

In the FIGURE is to be found an electric motor M which preferably is in the form of an electric stepping motor such as taught for example in U.S. Pat. No. 3,845,335. Such motor will be energized from a miniature dry cell (not shown) and the timing of energy pulses will be accomplished by means of an electronic circuit (also not shown) which may be controlled by a quartz crystal in a manner which is by now well known in the art.

DETAILED DESCRIPTION OF THE INVENTION

In the preferred embodiment of the invention the electronic circuit is arranged so as to deliver one pulse each minute to motor M. The pulse timing, of course, will be extremely precise in nature as determined in fact by the nature of the quartz controlled oscillator which regulates the entire movement.

The motor which is described in the above-mentioned U.S. patent is designed so that3at each pulse it rotates through 1/12th of a revolution. Such motion appears at motor pinion A which is arranged to mesh with a minute wheel B. In a typical execution of the invention pinion A will have 14 leaves and minute wheel B will have 70 teeth, thus providing a ratio of 1 to 5. Thus it will be appreciated that when pinion A rotates through 1/12th of the revolution minute wheel B will rotate through 1/60th of a revolution. In a well-known manner minute wheel B will be arranged to carry a minute hand which will thus be advanced successively through steps of 1 minute following the receipt of each motor driving pulse applied to motor M.

An important feature of the invention resides in the support arrangements made for the minute wheel and other mechanisms hereinafter to be described. Fitted to the motor cage of motor M is a supporting bracket H and solidly mounted therein is a support arbor G. As shown in the drawing arbor G extends upwardly to provide thereabove a reduced cross-section portion K on which is rotatably mounted the minute wheel B previously mentioned. Thus arbor G and bearing section K are held fixed by bracket H whereas minute wheel B is free to rotate thereon.

An enlarged section C of arbor G bears teeth thereon and in fact constitutes a fixed central gear of a planetary system. In the arrangement under consideration gear C will have 22 teeth.

Carried by minute wheel B is a pair of planet pinions D and E commonly mounted on a shaft L born within a bearing tube passing through the minute wheel B. Planet pinions D and E are fastened to shaft L and rotate together. Planet pinion D may have 24 teeth and is arranged to mesh with fixed gear C. Planet pinion E likewise has 24 teeth thereon and is arranged to mesh directly with hour wheel F. Hour wheel F likewise is provided with 24 teeth and is mounted in the well-known manner as a hollow cannon wheel over the pipe portion of minute wheel B. In a well-known manner hour wheel F will carry an hour hand likewise not shown.

From the well-known manner in which planetary trains operate it will be evident that as minute wheel B rotates plane pinion D is likewise forced to rotate by its engagement with fixed central gear C. Accordingly, planetary pinion E likewise rotates and, so rotating, forces hour wheel F to rotate. The formula for the ratio of the train as shown is in accordance with the number of teeth on each of the respective gears and pinions $$1 - \frac{22}{24} \cdot \frac{24}{24}$$

whereby the reduction appears as 1 to 12. Since, as already explained, minute wheel B advances at 1/60th of a revolution each minute it follows that it will effect one complete revolution hour whereby hour wheel F will make 1/12th of a revolution each hour in accordance with the well-known arrangements of mechanical watches.

For such a type of watch movement it will be obvious that it is quite within the possibilities of electronics to provide a simple push-button control which will enable rapid corrections of minutes and rapid corrections of hours as for example when traversing time zones.

It will be appreciated that in such a watch extreme simplicity has been achieved, all the motionwork in a conventional type of movement has been eliminated and the base plate has been eliminated and finally a great degree of compactness may be achieved whereby the movement is suitable for a Ladies watch smaller than heretofore achieved in electronic quartz types.

The invention will be found particularly advantageous for employement with small timepieces such as wrist watches in which an electrically driven display has its basic control signals derived from a high precision frequency standard such as a quartz controlled oscillator and a frequency divider.

What is claimed is:

1. A wristwatch movement including an electric motor arranged to transmit motion to a minute hand and an hour hand wherein the motion work comprises a planetary train having a central minute wheel directly driven from the motor, said central minute wheel bearing a pair of eccentrically located coaxial planet pinions which are fixed for rotation together and one of which engages a fixed central gear and the other of which engages an hour wheel.

2. A wristwatch movement as set forth in claim 1 wherein the entire motion work is supported by the motor thereby to eliminate the conventional base plate.

3. A wristwatch movement as set forth in claim 2 wherein the motor cage is provided with a bracket to which a support arbor is fixedly mounted.

4. A wristwatch movement as set forth in claim 3 wherein the support arbor has the central gear immovably fixed thereto and in addition provides a rotative support for the central minute wheel and the hour wheel, said central gear and said wheels being coaxial.

5. A wristwatch movement as set forth in claim 1 wherein a shaft bearing extends through said central minute wheel and carries a shaft freely rotatable therein, a planet pinion being fixed on each end of the shaft whereby rotation of the said central minute wheel effects rotation of the planet pinions and the hour wheel.

6. A wristwatch movement as set forth in claim 1 wherein an electronic circuit controlled by a quartz crystal time standard provides driving pulses to the motor.

7. A wristwatch movement as set forth in claim 6 wherein the motor comprises a stepping motor.

8. A wristwatch movement as set forth in claim 7 wherein the motor is stepped once per minute.

* * * * *